US008159441B2

(12) United States Patent
Yu

(10) Patent No.: US 8,159,441 B2
(45) Date of Patent: Apr. 17, 2012

(54) DRIVING APPARATUS FOR DRIVING GATE LINES IN DISPLAY PANEL

(75) Inventor: Chih-Min Yu, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 875 days.

(21) Appl. No.: 11/554,605

(22) Filed: Oct. 31, 2006

(65) Prior Publication Data

US 2008/0100558 A1 May 1, 2008

(51) Int. Cl.
*G09G 3/36* (2006.01)

(52) U.S. Cl. ..... 345/98

(58) Field of Classification Search ..... 345/87–102, 345/1.1, 76; 326/103; 438/30
See application file for complete search history.

(56) References Cited

U.S. PATENT DOCUMENTS 3,356,858 A * 12/1967 Wanlass ..... 326/103
5,432,529 A * 7/1995 Azuhata ..... 345/100
5,532,712 A * 7/1996 Tsuda et al. ..... 345/87
5,815,133 A * 9/1998 Tsuboyama et al. ..... 345/95
2003/0011557 A1* 1/2003 Koga et al. ..... 345/99
2003/0034939 A1* 2/2003 Moon ..... 345/76
2004/0174330 A1* 9/2004 Huang et al. ..... 345/100
2004/0189582 A1* 9/2004 Willis et al. ..... 345/99
2005/0156861 A1* 7/2005 Song ..... 345/100
2005/0179630 A1* 8/2005 Huang ..... 345/87
2005/0225354 A1* 10/2005 Chang ..... 326/81
2005/0227396 A1* 10/2005 Chang et al. ..... 438/30
2006/0001639 A1 1/2006 Chen et al.
2006/0028463 A1* 2/2006 Nakamura et al. ..... 345/204
2006/0038767 A1* 2/2006 Nakamura et al. ..... 345/100
2006/0132475 A1* 6/2006 Tseng ..... 345/204

FOREIGN PATENT DOCUMENTS

CN 1553420 12/2004

* cited by examiner

*Primary Examiner* — Chanh Nguyen
*Assistant Examiner* — Sanghyuk Park
(74) *Attorney, Agent, or Firm* — Jianq Chyun IP Office

(57) ABSTRACT

A driving apparatus suitable for driving a display panel which includes a plurality of gate lines is provided. The driving apparatus includes a driving unit and a voltage detecting unit. The driving unit is used to generate a plurality of output signals, so as to drive the gate lines with the output signals. The voltage detecting unit is electrically connected to the driving unit and generates a control signal according to the level of a logic driving voltage of the driving unit. The voltage detecting unit outputs the control signal to the driving unit, such that the driving unit generates the plurality of output signals simultaneously according to the control signal.

14 Claims, 4 Drawing Sheets

DRIVING APPARATUS FOR DRIVING GATE LINES IN DISPLAY PANEL

BACKGROUND OF THE INVENTION

1. Field of Invention

The present invention relates to a driving apparatus, and more particularly, to a driving apparatus capable of solving the fan-out phenomenon of a display panel.

2. Description of Related Art

If the user does not turn off the power of the backlight of the display panel, but only turns off the signals and the power of the signals when shutting down the computer host, the displayed picture on the display panel will be disappearing with an extremely slow speed. On the contrast, if the power of the backlight, the signals and the power of the signals are all turned off when shutting down the host, faint changes of the light and shadow still occur like tides on the display panel, that is, the fan-out phenomenon caused by different discharging speed of each pixel transistor due to uneven film thicknesses of the thin film transistors in the display panel. In particular, at the instance of turning off the power, different film thicknesses of the thin film transistors resulting in different capacitances, such that the required discharging time is different, and thus, the time for liquid crystals to rotate and recover is different, thereby causing a ghost picture as ebb tide to occur on the panel.

Therefore, in order to eliminate the fan-out phenomenon, some display panel designers and manufacturers provide several solutions of this problem, as shown in FIG. 1 and FIG. 2. FIG. 1 is a block diagram of an architecture of a conventional gate driver, and FIG. 2 is a signal timing diagram of the conventional gate driver. Refer to FIG. 1 and FIG. 2 for the illustration.

Referring to FIG. 1, an input buffer 101, a shift register 102, a level shifter 103, an output buffer 104 and a reset circuit 105 are shown. The input buffer 101 is used to buffer a clock signal CPV, a start signal STV, an output enable signal OE and a full output enable signal Xon. The shift register 102 generates N shift signals according to the clock signal CPV and the start signal STV, and then, outputs the N shift signals according to the output enable signal OE, so as to form N output signals. The level shifter 103 receives and shifts the signal levels of the N output signals, and then, outputs the N output signals with shifted signal levels after being buffered by the output buffer 104, i.e., OUT1-OUTN respectively, so as to sequentially drive the gates line G1-GN (not shown) of the display panel.

Referring to FIG. 1 and FIG. 2, when the user shuts down the computer, the shift register 102 generates N output signals simultaneously according to the full output enable signal Xon (as shown by 201 in FIG. 2) output by the reset circuit 105, and the gate driver further outputs N output signals OUT1-OUTN-1, OUTN simultaneously (as shown by 202 in FIG. 2), so as to drive the gate lines G1-GN of the display panel simultaneously. Therefore, the fan-out phenomenon caused by different discharging speed of each pixel transistor in the display panel is eliminated.

However, the full output enable signal Xon must be controlled by the reset circuit 105 on the printed circuit board (PCB) of the display panel, and the reset circuit 105 employs the existed reset IC, thus, if the conventional architecture as shown in FIG. 1 is used to eliminate the fan-out phenomenon, not only the reset IC is additionally used on the PCB, causing the burden of the manufacturing cost, but additional PCB wiring is also required for the reset IC, as a result, the design and manufacturing of the display panel becomes time consuming and labor intensive, which is quite disadvantageous to those display panel manufacturers who want to reduce the manufacturing cost and increase the profit of products.

SUMMARY OF THE INVENTION

An objective of the present invention is to provide a driving apparatus, which aims to solve the fan-out phenomenon of a display panel without disposing a reset IC on the PCB of the display panel.

Based on the above or other objectives, the present invention provides a driving apparatus suitable for driving a display panel having a plurality of gate lines. The driving apparatus comprises a driving unit and a voltage detecting unit. The driving unit is used to generate a plurality of output signals, so as to drive the gate lines with the output signals. The voltage detecting unit is electrically connected to the driving unit and generates a control signal according to the level of a logic driving voltage of the driving unit. The voltage detecting unit outputs the control signal to the driving unit, such that the driving unit generates the plurality of output signals simultaneously according to the control signal.

According to an embodiment of the present invention, the driving unit comprises a shift register unit used to receive a start signal, a clock signal, an output enable signal and a control signal. The shift register unit generates a plurality of shift signals according to the start signal and the clock signal, and then, outputs the shift signals according to the output enable signal, so as to form output signals. The shift register unit also generates the output signals simultaneously according to the control signal.

According to an embodiment of the present invention, the shift register unit comprises a shift register and a logic control circuit. The shift register is used to receive the start signal and the clock signal, and then generates the plurality of shift signals according to the start signal and the clock signal. The logic control circuit is electrically connected to the shift register and the voltage detecting unit, and used for receiving the output enable signal, the plurality of shift signals and the control signal. The logic control circuit outputs the plurality of shift signals according to the output enable signal, so as to form the output signals, and the logic control circuit also generates the output signals simultaneously according to the control signal.

According to an embodiment of the present invention, the voltage detecting unit comprises a comparison circuit and a select circuit. The comparison circuit is electrically connected to the logic driving voltage of the driving unit and a reference voltage for comparing the value of the logic driving voltage with that of the reference voltage and then outputting a comparison signal accordingly. The select circuit is electrically connected to the logic driving voltage of the driving unit and a ground voltage for determining whether to output the logic driving voltage of the driving unit or the ground voltage according to the comparison signal.

According to an embodiment of the present invention, the select circuit comprises a first transistor and a second transistor, wherein the first transistor is a P-type metal-oxide-semiconductor transistor (PMOS), and the second transistor is an N-type metal-oxide-semiconductor transistor (NMOS). The comparison circuit comprises a comparator having a positive input terminal, a negative input terminal, and an output terminal. The gate of the first transistor receives the comparison signal, and one source/drain of the first transistor is electrically connected to the logic driving voltage of the driving unit. The gate of the second transistor also receives the comparison signal, one source/drain of the second transistor is electrically connected to the other source/drain of the first transistor, and the other source/drain of the second transistor is electrically connected to the ground voltage. The negative input terminal of the comparator is electrically connected to the logic driving voltage of the driving unit, the positive input terminal of the comparator is electrically connected to the reference voltage, and the output terminal of the comparator is electrically connected to the gates of the first transistor and the second transistor.

According to an embodiment of the present invention, the logic control circuit comprises a plurality of AND gates and a plurality of OR gates. One input terminal of each AND gate receives an inversion signal of the output enable signal, and the other input terminal of each AND gate correspondingly receives one of the plurality of shift signals. One input terminal of each OR gate receives an inversion signal of the control signal, the other input terminal of each OR gate correspondingly receives the output terminal of one of the AND gates, and the output terminals of the OR gates output the output signals.

In the present invention, a voltage detecting unit is employed in the driving apparatus, and the voltage detecting unit is used to compare the value of the preset reference voltage with that of the logic driving voltage of the driving unit, so as to generate a control signal. When the user shuts down the computer, the voltage detecting unit outputs the control signal to the shift register unit in the driving apparatus, such that the shift register unit outputs a plurality of output signals simultaneously, so as to drive the gate lines of the display panel simultaneously, thereby eliminating the fan-out phenomenon caused by different discharging speed of each pixel transistor in the display panel.

Therefore, in the present invention, no additional reset ICs are required to be disposed on the PCB, thus reducing the burden of the manufacturing cost, and no additional PCB wiring for the reset IC is required, thus simplifying the flow of designing and manufacturing the display panel.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
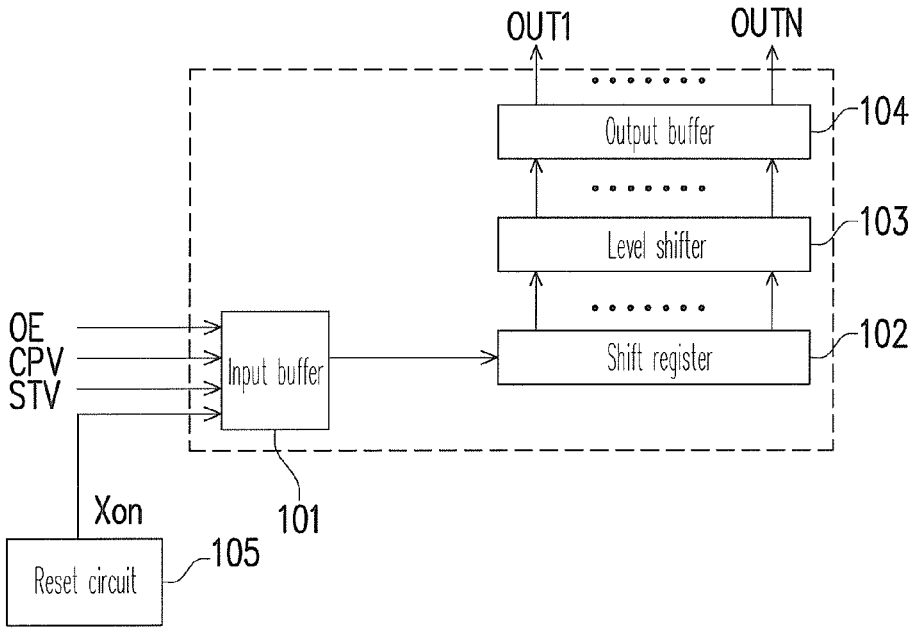
FIG. 1 (PRIOR ART)
FIG. 1 is a block diagram of an architecture of a conventional gate driver.
Figure 2:
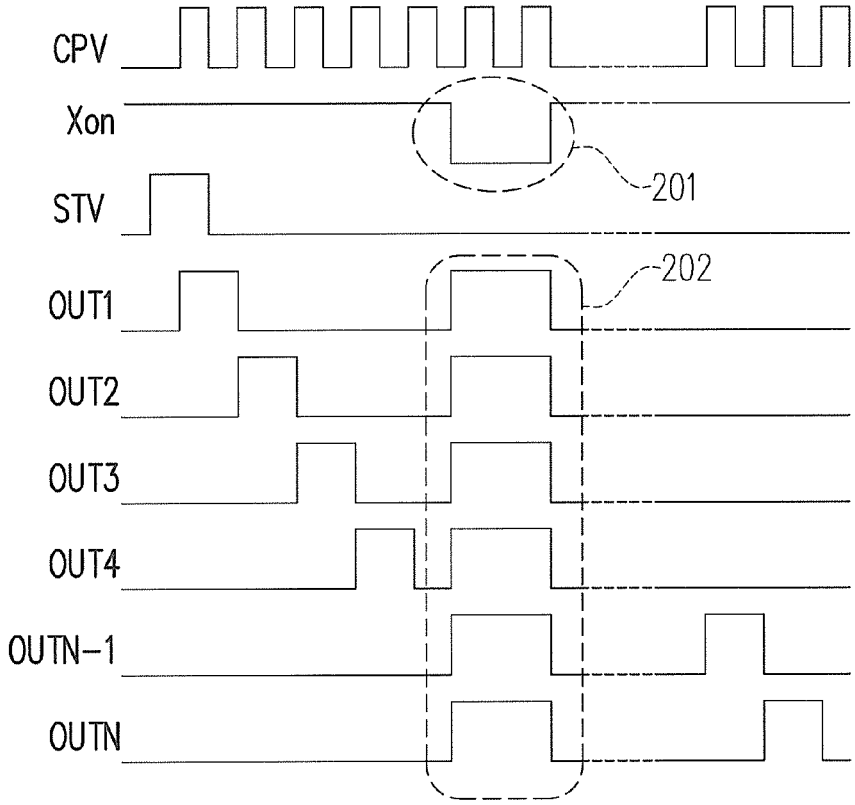
FIG. 2 (PRIOR ART)
FIG. 2 is a signal timing diagram of the conventional gate driver.
Figure 3:
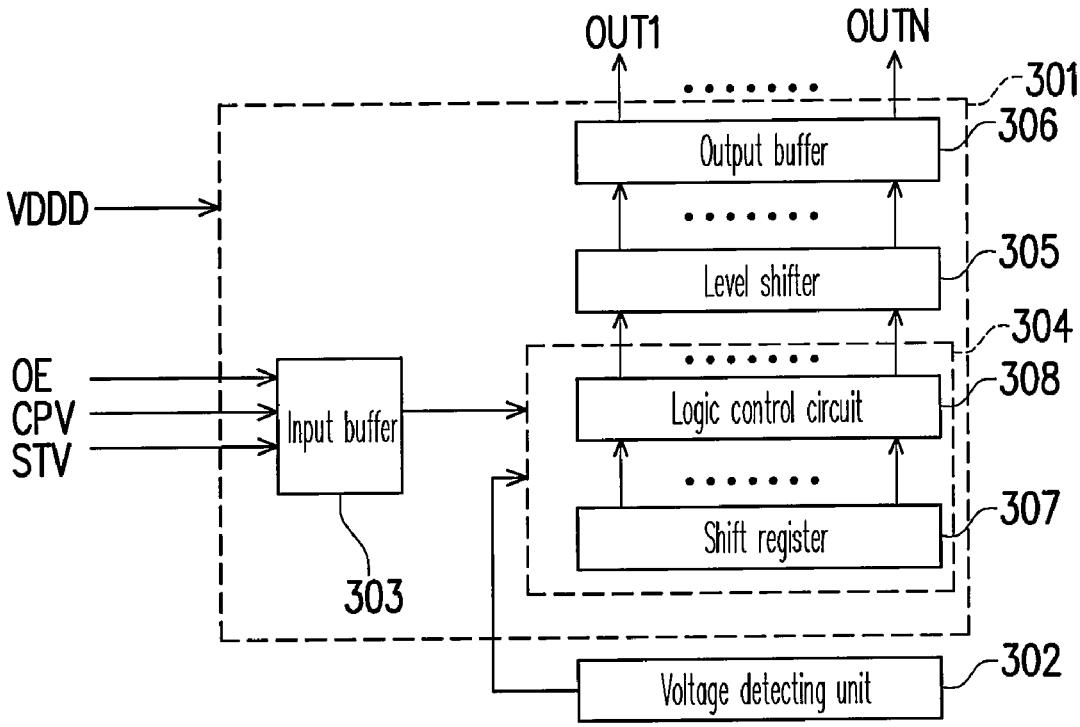
FIG. 3 is a block diagram of an architecture of a driving apparatus according to an embodiment of the present invention.

FIG. 3 is a block diagram of an architecture of a driving apparatus according to an embodiment of the present invention. Referring to FIG. 3, the driving apparatus as shown in FIG. 3 comprises a driving unit 301 and a voltage detecting unit 302. In this embodiment, the driving unit 301 receives an external voltage as a logic driving voltage VDDD of the driving unit 301. The driving unit 301 is used to generate N output signals, i.e., OUT1-OUTN respectively, so as to drive the gate lines G1-GN (not shown) of the display panel with the output signals OUT1-OUTN.

The voltage detecting unit 302 is electrically connected to the driving unit 301 and generates a control signal CS according to the level of the logic driving voltage VDDD of the driving unit 301. The voltage detecting unit 302 outputs the control signal CS to the driving unit 301, such that the driving unit 301 generates the output signals OUT1-OUTN simultaneously according to the control signal CS. When the driving unit 301 generates the output signals OUT1-OUTN simultaneously, thereby driving the gate lines G1-GN of the display panel simultaneously, the fan-out phenomenon caused by different discharging speed of each pixel transistor in the display panel can be eliminated.

In this embodiment, the driving unit 301 comprises an input buffer 303, a shift register unit 304, a level shifter 305 and an output buffer 306. However, since the design of the driving unit 301 varies depending on different manufacturers, the elements included in the driving unit 301 are not limited by this embodiment. The input buffer 303 is electrically connected to the shift register unit 304 and used for receiving and buffering a start signal STV, a clock signal CPV and an output enable signal OE. The shift register unit 304 is used to receive the start signal STV, the clock signal CPV and the output enable signal OE buffered by the input buffer 303, and the shift register unit 304 also receives the control signal CS generated by the voltage detecting unit 302.

The shift register unit 304 generates N shift signals according to the clock signal CPV and the start signal STV, and then outputs the N shift signals according to the output enable signal OE, so as to form N output signals. The level shifter 305 receives and shifts the signal levels of the N output signals, and then outputs the N output signals, i.e. OUT1-OUTN respectively, with shifted signal levels after being buffered by the output buffer 306, so as to drive the gate lines G1-GN (not shown) of the display panel in sequence. The shift register unit 304 also generates the N output signals simultaneously according to the control signal CS.

The shift register unit 304 comprises a shift register 307 and a logic control circuit 308. The shift register 307 is used to receive the start signal STV and the clock signal CPV, and then generate the plurality of shift signals according to the start signal STV and the clock signal CPV. The logic control circuit 308 is electrically connected to the shift register 307 and the voltage detecting unit 302 and used for receiving the output enable signal OE, the N shift signals and the control signal CS. The logic control circuit 308 outputs the N shift signals according to the output enable signal OE so as to form N output signals. The logic control circuit 308 also generates the N output signals simultaneously according to the control signal CS.

Figure 4:
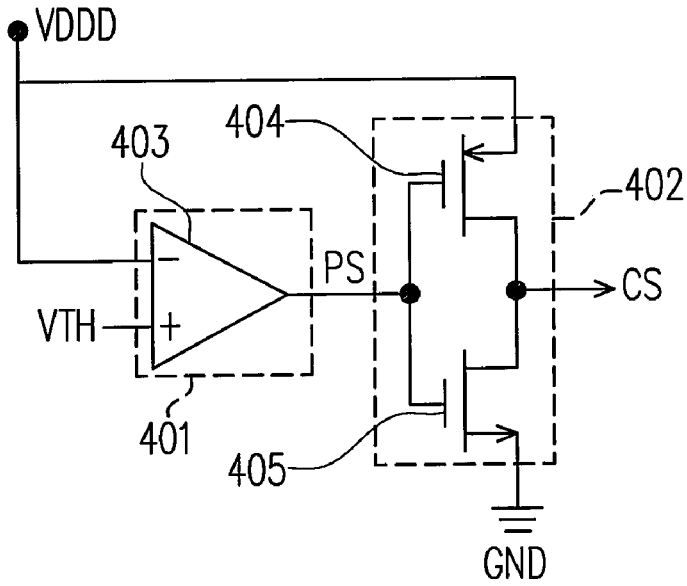
FIG. 4 is a circuit diagram of a voltage detecting unit according to an embodiment of the present invention.

FIG. 4 is a circuit diagram of a voltage detecting unit according to an embodiment of the present invention. Referring to FIG. 4, it shows the internal circuit of the voltage detecting unit 302 of FIG. 3, which comprises a comparison circuit 401 and a select circuit 402. The comparison circuit 401 is electrically connected to the logic driving voltage VDDD of the driving unit and a reference voltage VTH for comparing the value of the logic driving voltage VDDD with that of the reference voltage VTH, and then outputting a comparison signal PS accordingly. The select circuit 402 is electrically connected to the logic driving voltage VDDD of the driving unit and a ground voltage GND for determining whether to output the logic driving voltage VDDD of the driving unit or the ground voltage GND according to the comparison signal PS.

In this embodiment, the comparison circuit 401 is implemented by a comparator 403, and the select circuit 402 is implemented by a transistor 404 and a transistor 405, wherein the transistor 404 is a PMOS transistor, and the transistor 405 is an NMOS transistor.

The comparator 403 having a positive input terminal electrically connected the reference voltage VTH, a negative input terminal electrically connected to the logic driving voltage VDDD of the driving unit, and an output terminal electrically connected to the gates of the transistor 404 and the transistor 405. The gate of the transistor 404 receives the comparison signal PS, the source of the transistor 404 is electrically connected to the logic driving voltage VDDD of the driving unit. The gate of the transistor 405 receives the comparison signal PS, the drain of the transistor 405 is electrically connected to the drain of the transistor 404, and the source of the transistor 405 is electrically connected to the ground voltage GND.

However, the user certainly can change the internal design of the comparison circuit 401 and/or the select circuit 402 according to the actual demand, and the above recited implementation is not used to limit the internal design of the comparison circuit 401 and the select circuit 402.

When the logic driving voltage VDDD received by the comparator 403 is less than the reference voltage VTH, the comparison signal PS output by the comparator 403 is of high logic, such that the transistor 404 is turned off and the transistor 405 is turned on, therefore, the control signal CS output by the voltage detecting unit 302 is the ground voltage GND (i.e., low logic). When the logic driving voltage VDDD received by the comparator 403 is larger than the reference voltage VTH, the comparison signal PS output by the comparator 403 is of low logic, such that the transistor 404 is turned on and the transistor 405 is turned off, therefore, the control signal CS output by the voltage detecting unit 302 is the logic driving voltage VDDD (i.e., high logic). Therefore, the voltage detecting unit 302 is used to compare the value of the logic driving voltage VDDD with that of the reference voltage VTH, so as to determine whether the control signal CS is of high logic or low logic, thus, the driving unit 301 as shown in FIG. 3 may generate the output signals OUT1-OUTN simultaneously according to the state of the control signal CS.

Figure 5:
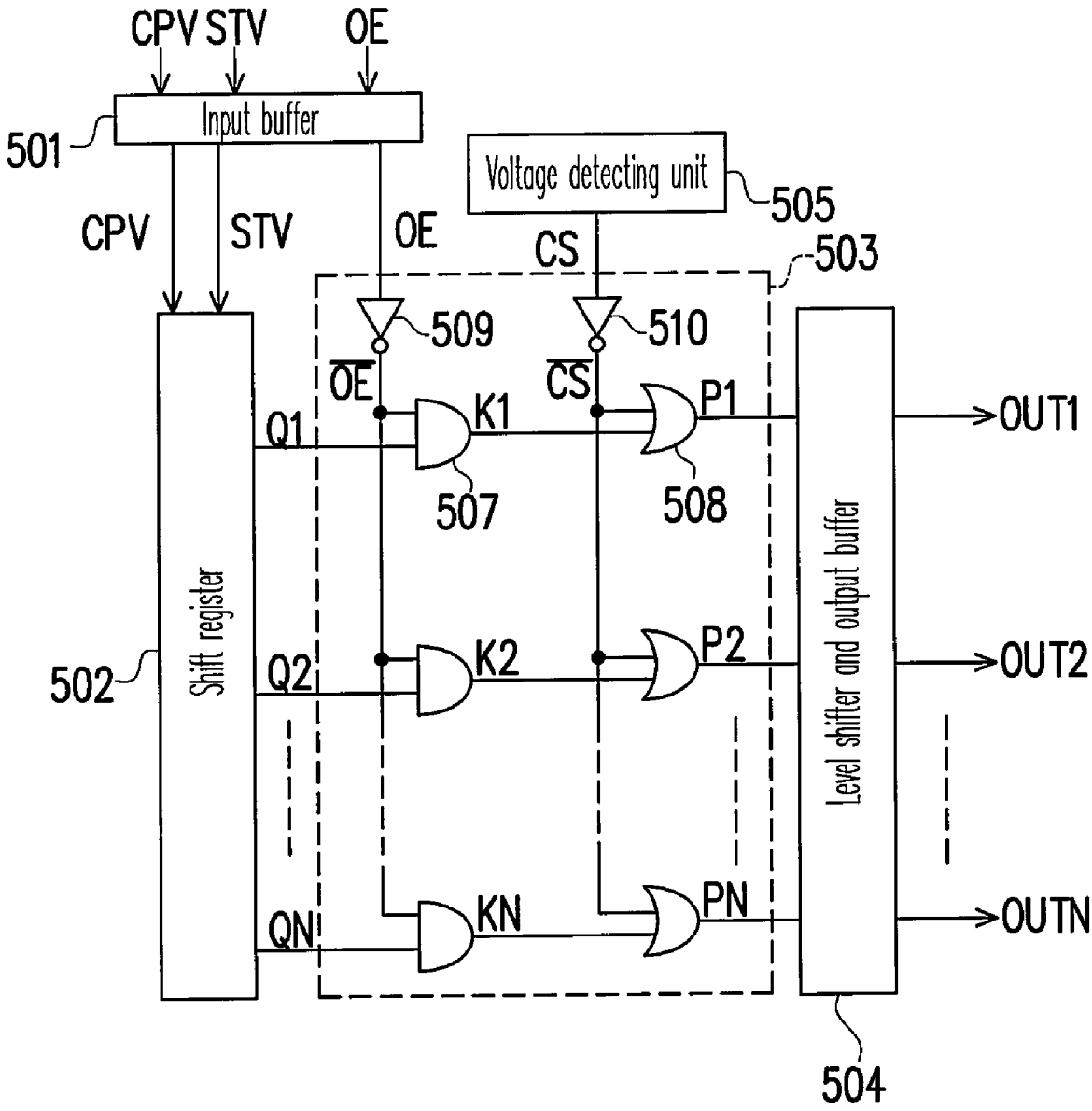
FIG. 5 is an internal circuit diagram of a driving apparatus according to an embodiment of the present invention.

Refer to FIG. 3 and FIG. 5 for the illustration. FIG. 5 is an internal circuit diagram of a driving apparatus according to an embodiment of the present invention. Referring to FIG. 5, an input buffer 501, a shift register 502, a logic control circuit 503 and a voltage detecting unit 505 as shown in FIG. 5 are the input buffer 303, the shift register 307, the logic control circuit 308 and the voltage detecting unit 302 as shown in FIG. 3 respectively; and a level shifter and output buffer 504 as shown in FIG. 5 is a combination of the level shifter 305 and the output buffer 306 as shown in FIG. 3.

A voltage detecting unit 505 as shown in FIG. 5 adopts the design manner of the voltage detecting unit shown in FIG. 4, and a logic control circuit 503 as shown in FIG. 5 is actually designed according to the internal circuit of the logic control circuit 308 shown in FIG. 3. The logic control circuit 503 comprises N AND gates 507, N OR gates 508 and inverters 509 and 510. One input terminal of each AND gate 507 receives an inversion signal/OE of the output enable signal OE, the other input terminal of each AND gate 507 correspondingly receives one of the shift signals Q1-QN. One input terminal of each OR gate 508 receives an inversion signal /CS of the control signal CS, the other input terminal of each OR gate 508 is correspondingly coupled to the output terminal of one of the AND gates 507, and the output terminals of the OR gates 508 output the output signals P1-PN.

However, in the embodiment of FIG. 5, the voltage detecting unit 505 is not limited to the design manner of the voltage detecting unit shown in FIG. 4. In addition, a logic control circuit is generally designed in a common driving apparatus to perform the logic calculation of the signals in the driving apparatus. Nevertheless, since the design of the logic control circuit varies depending on different manufacturers, the circuit architecture of the logic control circuit 503 as shown in FIG. 5 is not used to limit the design manner of the internal circuit for the logic control circuit.

Refer to FIG. 4 and FIG. 5 for the illustration. Referring to FIG. 4 first, when the display operates in a normal operation, the logic driving voltage VDDD is larger than the reference voltage VTH at this time, thus, the control signal CS is of high logic. Referring to FIG. 5, under the above circumstance, the control signal CS output by the voltage detecting unit 505 is inverted into an inversion signal /CS (i.e., low logic) thereof by the inverter 510, thus, the N OR gates 508 in the logic control circuit 503 operate according to the signals K1-KN output by the N AND gates 507, thereby making the driving apparatus normally output the output signals OUT1-OUTN in sequence, so as to drive the gate lines G1-GN (not shown) of the display panel in sequence.

Figure 6:
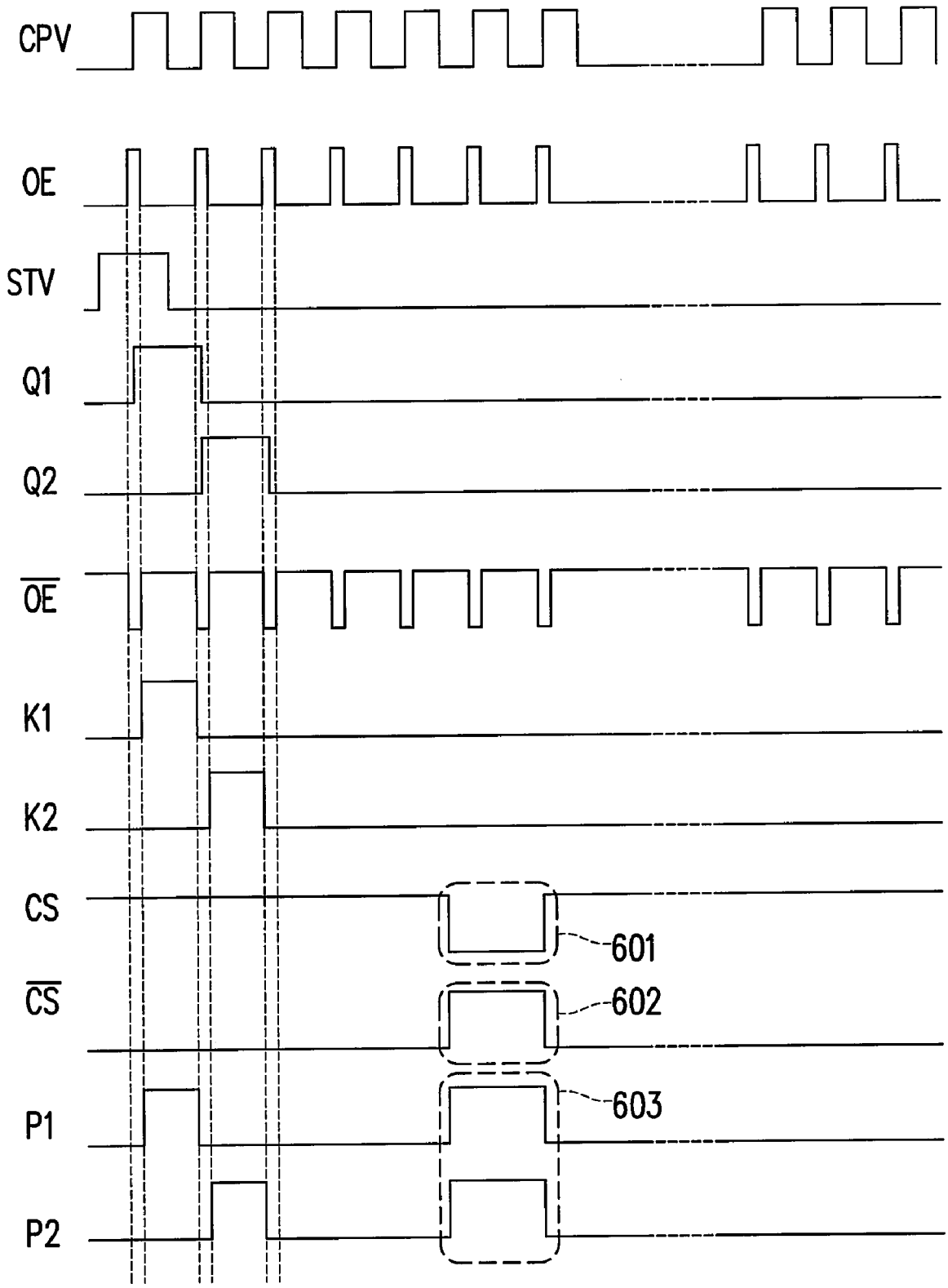
FIG. 6 is a timing diagram of a part of internal signals for the driving apparatus according to an embodiment of the present invention.

Referring to FIG. 4, when the user shuts down the display, the voltage detecting unit 505 detects the logic driving voltage VDDD. When the logic driving voltage VDDD is less than the reference voltage VTH, thus, the control signal CS is of low logic. FIG. 6 is a timing diagram of a part of internal signals for the driving apparatus according to an embodiment of the present invention. Referring to FIG. 5 and FIG. 6, under the above circumstance, the control signal CS output by the voltage detecting unit 505 of FIG. 5 (also of low logic, as shown by 601 in FIG. 6) is inverted into the inversion signal/CS (i.e., high logic, as shown by 602 in FIG. 6) thereof by the inverter 510. Thus, the N OR gates 508 in the logic control circuit 503 output the output signals P1-PN of high logic simultaneously according to the inversion signal /CS of high logic, as shown by P1 and P2 listed in 603 of FIG. 6, wherein P1 and P2 of FIG. 6 are signal states corresponding to P1 and P2 of FIG. 5.

The level shifter in the level shifter and output buffer 504 of FIG. 5 is used to receive and shift the signal levels of the N output signals P1-PN, and then, the N output signals with shifted signal levels are buffered by the output buffer in the level shifter and output buffer 504, and then are output, i.e., OUT1-OUTN respectively, so as to drive the gate lines G1-GN (not shown) of the display panel simultaneously. As such, the fan-out phenomenon caused by different discharging speed of each pixel transistor in the display panel can be eliminated.

It should be noted that, a possible design manner of the voltage detecting unit and the internal circuit for the logic control circuit has been described in the above embodiment, however, those skilled in the art should know that, the design of the voltage detecting unit and the logic control circuit varies depending on different manufacturers, thus, the present invention is not limited to this possible configuration. In other words, it is covered by the spirit of the present invention as long as the control signal is generated by comparing the value of the preset reference voltage with that of the logic driving voltage of the driving unit, and then, the control signal is received by the original logic control circuit in the driving apparatus, thereby making the driving apparatus generate all output signals simultaneously, so as to drive the gate lines of the display panel simultaneously.

To sum up, in the present invention, a voltage detecting unit is employed in the driving apparatus, and the voltage detecting unit is used to compare the value of the preset reference voltage with that of the logic driving voltage of the driving unit, so as to generate the control signal. When the user shuts down the computer, the voltage detecting unit outputs the control signal to the shift register unit in the driving apparatus, such that the shift register unit outputs a plurality of output signals simultaneously, thereby driving the gate lines of the display panel simultaneously, thus eliminating the fan-out phenomenon caused by different discharging speed of each pixel transistor in the display panel.

Therefore, in the present invention, no additional reset ICs are required to be disposed on the PCB, thus reducing the burden of the manufacturing cost, and no additional PCB wiring for the reset IC is required, thus simplifying the flow of designing and manufacturing the display panel.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving apparatus, for driving a display panel of a display, the display panel having a plurality of gate lines, the driving apparatus comprising:

a driving unit, for generating a plurality of output signals, so as to drive the gate lines with the output signals; and a voltage detecting unit, electrically connected to the driving unit, for generating a control signal by comparing a logic driving voltage directly supplied to the driving unit with a reference voltage, wherein when the display operates in a normal operation, the voltage detecting unit outputs the control signal with a first logic state to the driving unit, such that the driving unit sequentially generates the output signals to sequentially turn on the gate lines; and when the display is shut down at the moment, the voltage detecting unit outputs the control signal with a second logic state to the driving unit, such that the driving unit simultaneously generates the output signals to simultaneously turn on the gate lines, wherein the driving apparatus is a gate driver of the display for driving the gate lines in the display panel.

2. The driving apparatus as claimed in claim 1, wherein the driving unit comprises a shift register unit for receiving a start signal, a clock signal, an output enable signal and the control signal, wherein the shift register unit generates a plurality of shift signals according to the start signal and the clock signal, and then outputs the shift signals according to the output enable signal, so as to form the output signals; wherein the shift register unit generates the output signals simultaneously according to the control signal with the second logic state; and the shift register unit generates the output signals sequentially according to the control signal with the first logic state.

3. The driving apparatus as claimed in claim 2, wherein the shift register unit comprises:

a shift register, for receiving the start signal and the clock signal, and generating the shift signals according to the start signal and the clock signal; and a logic control circuit, electrically connected to the shift register and the voltage detecting unit, for receiving the output enable signal, the shift signals and the control signal, wherein the logic control circuit outputs the shift signals according to the output enable signal, so as to form the output signals; wherein the logic control circuit generates the output signals simultaneously according to the control signal with the second logic state; and the logic control circuit generates the output signals sequentially according to the control signal with the first logic state.

4. The driving apparatus as claimed in claim 3, wherein the logic control circuit comprises a plurality of AND gates and a plurality of OR gates, wherein one input terminal of each AND gate receives an inversion signal of the output enable signal, the other input terminal of each AND gate correspondingly receives one of the shift signals, one input terminal of each OR gate receives an inversion signal of the control signal, the other input terminal of each OR gate correspondingly coupled to the output terminal of one of the AND gates, and the output terminals of the OR gates output the output signals.

5. The driving apparatus as claimed in claim 4, wherein the logic control circuit further comprises a first inverter for receiving the output enable signal, so as to invert the output enable signal into an inversion signal.

6. The driving apparatus as claimed in claim 4, wherein the logic control circuit further comprises a second inverter for receiving the control signal, so as to invert the control signal into an inversion signal.

7. The driving apparatus as claimed in claim 2, wherein the driving unit further comprises:

a level shifter, electrically connected to the shift register unit, for receiving the output signals and shifting signal levels of the output signals.

8. The driving apparatus as claimed in claim 7, wherein the driving unit further comprises:

an output buffer, electrically connected to the level shifter, for receiving and buffering the output of the level shifter.

9. The driving apparatus as claimed in claim 2, wherein the driving unit further comprises:

an input buffer, electrically connected to the shift register unit, for receiving and buffering the start signal, the clock signal and the output enable signal.

10. The driving apparatus as claimed in claim 1, wherein the voltage detecting unit comprises:

a comparison circuit, electrically connected to the logic driving voltage directly supplied to the driving unit and the reference voltage, for comparing the value of the logic driving voltage with that of the reference voltage, and then outputting a comparison signal accordingly;

a select circuit, electrically connected to the logic driving voltage directly supplied to the driving unit and a ground voltage, for determining whether to output the logic driving voltage directly supplied to the driving unit or the ground voltage according to the comparison signal.

11. The driving apparatus as claimed in claim 10, wherein the select circuit comprises:

a first transistor, with a gate for receiving the comparison signal, and with one source/drain being electrically connected to the logic driving voltage directly supplied to the driving unit; and a second transistor, with a gate for receiving the comparison signal, with one source/drain being electrically connected to the other source/drain of the first transistor, and with the other source/drain being electrically connected to the ground voltage.

12. The driving apparatus as claimed in claim 11, wherein the comparison circuit comprises a comparator having a positive input terminal electrically connected the reference voltage, a negative input terminal electrically connected to the logic driving voltage directly supplied to the driving unit, and an output terminal electrically connected to the gates of the first transistor and the second transistor.

13. The driving apparatus as claimed in claim 12, wherein the first transistor comprises a PMOS transistor.

14. The driving apparatus as claimed in claim 13, wherein the second transistor comprises an NMOS transistor.

* * * * *